US005975868A

United States Patent [19]

Agner

[11] Patent Number: 5,975,868

[45] Date of Patent: Nov. 2, 1999

[54] VANE PUMP PRECOMPRESSION CHAMBER

[75] Inventor: Ivo Agner, Bad Homburg, Germany

[73] Assignee: Luk Fahrzeug-Hydraulik GmbH & Co. KG, Germany

[21] Appl. No.: 08/885,600

[22] Filed: Jun. 30, 1997

[30] Foreign Application Priority Data

Jun. 29, 1996 [DE] Germany ..... 196 26 211

[51] Int. Cl.[6] ..... F04C 2/344

[52] U.S. Cl. ..... 418/259

[58] Field of Search ..... 418/150, 259, 418/267, 268

[56] References Cited

U.S. PATENT DOCUMENTS

| | | | |
|---|---|---|---|
| 3,790,314 | 2/1974 | Swain et al. | 418/1 |
| 4,610,614 | 9/1986 | Haga et al. | 418/269 |
| 5,466,135 | 11/1995 | Draskovits et al. | 418/268 |

FOREIGN PATENT DOCUMENTS

| | | | |
|---|---|---|---|
| 2326627 | 12/1973 | Germany . | |
| 4126022 | 2/1993 | Germany . | |
| 4209840 | 9/1993 | Germany . | |
| 60-256580 | 12/1985 | Japan | 418/150 |

OTHER PUBLICATIONS

Patent Abstracts of Japan, vol. 10, No. 291, Oct. 3, 1986 & JP 61 106991 (Toyoda Mach Works Ltd.) May 24, 1986.
Patent Abstracts of Japan, vol. 16, No. 206, May 15, 1992 & JP 04 031682 (Toyoda Mach Works Ltd.), Feb. 3, 1992.

*Primary Examiner*—John J. Vrablik
*Attorney, Agent, or Firm*—Ostrolenk, Faber, Gerb & Soffen, LLP

[57] ABSTRACT

A vane pump includes a rotatable rotor in a housing. The rotor has radial slots and radially movable vanes in the slots engage a contour ring that extends around the rotor and defines the bore. End faces of the bore having sealing surfaces closing the bore. One sealing surface has intake and delivery openings which are assigned to intake and discharge regions around the bore. Each region is located between two adjacent vanes as the vanes rotate through the regions. The contour ring surrounds the vanes and is shaped for forming an enlarging intake region, a following, decreasing precompression region and a later following, decreasing discharge region. The intake and discharge regions are connected with the intake and delivery openings, respectively. The precompression region volume changes so that the kinematic precompression is in a delivery cell between two vanes at that region is greater than a desired precompression. The intake opening has a widening which extends in the direction of rotation and opens into the precompression region to diminish an otherwise steep increase in the pressure in the precompression region to bring that pressure to a desired value.

11 Claims, 2 Drawing Sheets

VANE PUMP PRECOMPRESSION CHAMBER

BACKGROUND OF THE INVENTION

The invention relates to a vane pump and particularly to the profile of the contour ring around the vanes that establishes the chambers of the pump and to a precompression chamber in the pump.

Vane pumps of this type are generally known. They usually comprise a rotor having a circumferential wall with radial slots which receive vanes. The rotor rotates within a contour ring which, in a double-stroke vane pump, forms two crescent shaped delivery spaces through which the vanes run. A fluid inlet opening and a fluid outlet opening are assigned to each of these delivery spaces. The fluid to be delivered is sucked through the inlet opening into a delivery cell formed between two vanes and is later discharged again from the cell through the outlet opening.

The fluid is delivered due to the geometry of the contour ring, as the vane cell volumes become larger in the intake region and smaller in the discharge region.

In particular when such vane pumps are used in conjunction with automatic transmissions, there is a disadvantage that the air contained in the fluid, which is particularly hydraulic oil, is greatly compressed very quickly, and this leads to disturbing cavitation noises.

To avoid these noises, it has been proposed to design the contour ring so as to achieve a slight increase in pressure. However, this has a disadvantage that the increase in pressure becomes very dependent on tolerances with regard to the shape of the contour ring. Even small production related fluctuations in the course of the contour ring consequently lead to tangible changes when the pressure increases. If there is an excessive increase in pressure as a result, this again leads to cavitation noises.

SUMMARY OF THE INVENTION

The object of the invention therefore is to provide a vane pump in which no or only slight cavitation noises occur.

This object is achieved by a vane pump having the features described herein. A vane pump has a rotatable rotor in its housing. The rotor has radial slots. Radially movable vanes in the slots engage a contour ring that extends around and defines the bore. End faces of the bore have sealing surfaces closing the bore. One sealing surface has intake and delivery openings therein assigned to intake and discharge regions around the bore and each such region is located between two adjacent vanes as the vanes rotate through the regions.

The contour ring surrounds the vanes. The contour ring is shaped for forming an enlarging intake region, a following, decreasing precompression region and a later following, decreasing discharge region. The intake and discharge regions are connected with the intake and delivery openings, respectively.

The precompression region volume changes so that the kinematic precompression in a delivery cell between two vanes at that region is greater than a desired precompression. The intake opening has a widening which extends in the direction of rotation and opens into the precompression region to diminish an otherwise steep increase in the pressure in the precompression region to bring that pressure to a desired value.

Because the contour ring is designed so as to achieve a substantial kinematic precompression, the sensitivity to tolerance can be reduced. Kinematic precompression is understood to be compression brought about solely by the geometry of the contour ring, that is to say the reduction in the cell volume. Production related fluctuations in the course of the contour ring have only a negligible effect on precompression. The ensuing great increase in pressure, which is actually undesirable, is diminished by widening the inlet opening, preferably with a notch extending in the direction of rotation of the rotor. Appropriate design of this widening of the opening adjusts the amount of the volume flowing back from a precompression region into the intake region and thus also adjusts the level of the pressure increase.

Other objects and features of the invention are explained in detail below with reference to the drawings.

DESCRIPTION OF A PREFERRED EMBODIMENT

Figure 1:
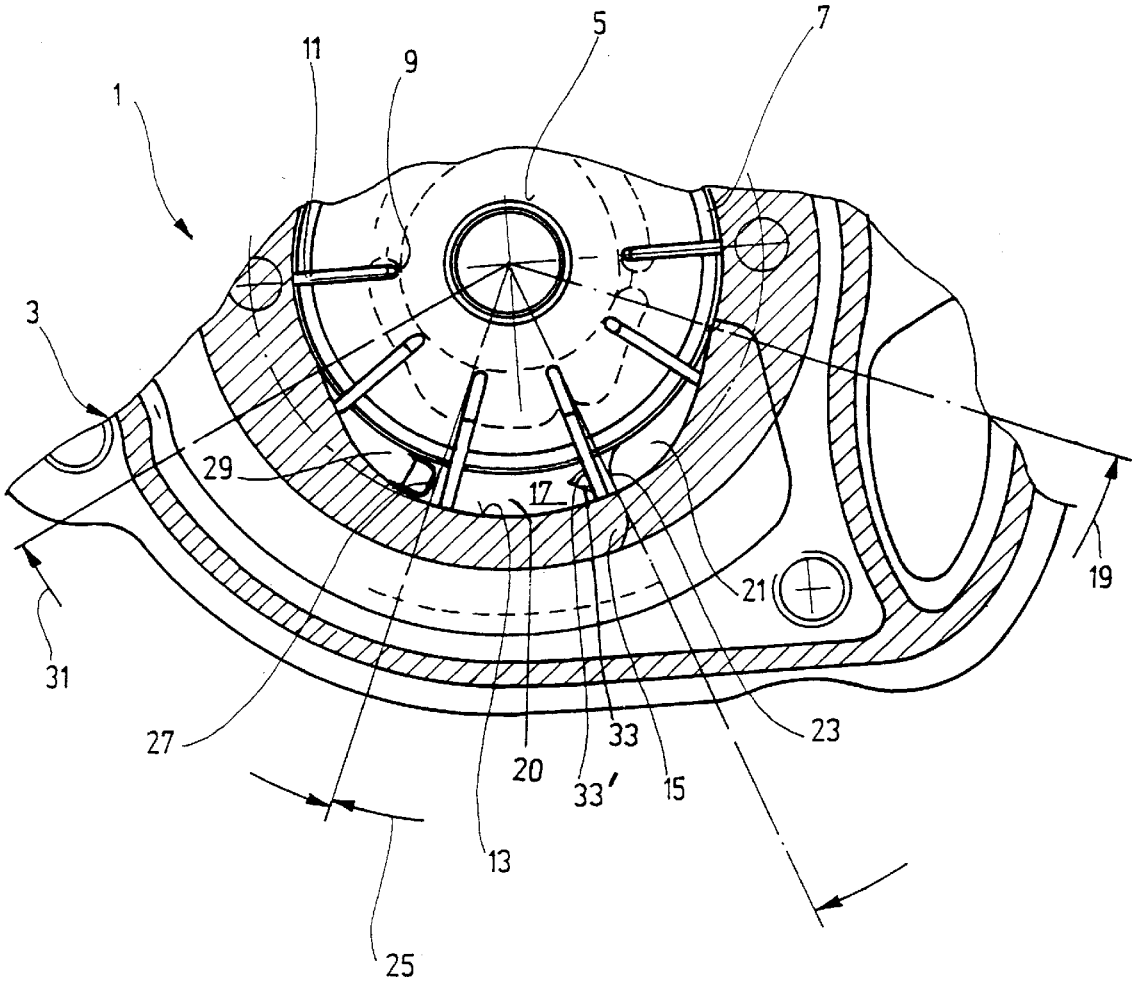
FIG. 1 diagrammatically shows a cross-section of a pump section of a double-stroke vane pump.

A vane pump 1 has a housing 3 in which a rotor 5 is mounted which can be rotated clockwise around the rotor axis.

A plurality of radially extending slots 9, ten in the present embodiment, are formed at intervals in the circumferential wall 7 of the rotor 5. The slots 9 receive radially displaceable vanes 11 with ends remote from the rotor which rest against an inside wall 13 of a contour ring 15 during rotation of the rotor 5.

Figure 2:
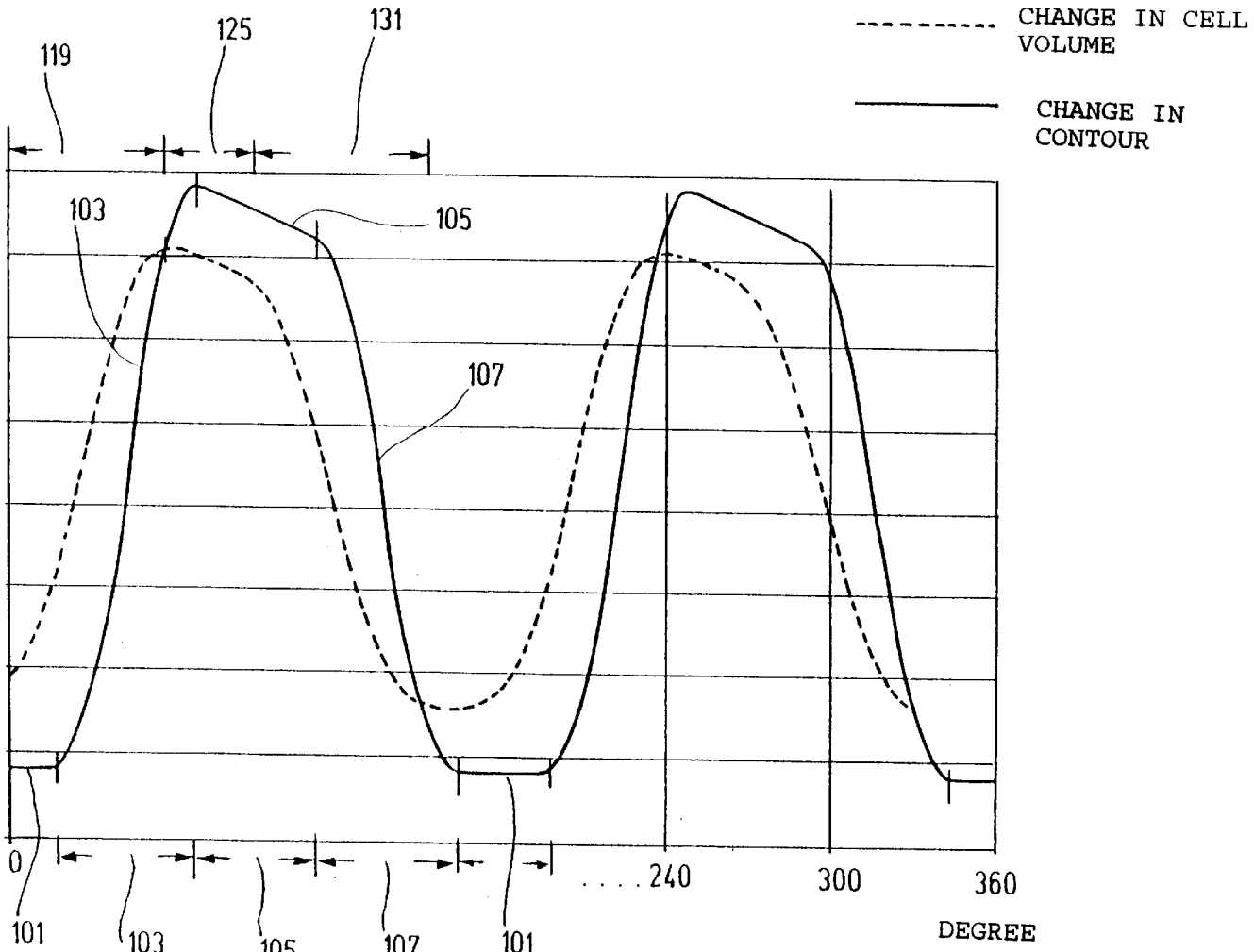
FIG. 2 shows a diagram of the course of the contour of the ring around the pump bore and of the variation in volume of a delivery cell.

The contour ring 15 is designed so that, in a double-stroke pump, the stroke course of the vanes illustrated in FIG. 2 results during one complete rotation of the rotor 5. Two angular ranges 101 are seen, in which the stroke, that is, a radical position of the vanes, remains essentially constant. Following these angular ranges in each case is a further angular range 103 in which the vane moves radially outward and thus undergoes an increasing stroke. During a further rotation of the rotor 5, the contour ring again presses the vane radially inward, in which case the reduction in the stroke is initially flat, that is to say relatively slow, within a range 105, and is steeper, that is to say faster, in a subsequent angular range 107. In the range 105, the change in stroke is greater than 3.5 $\mu$m/degree over an angle of at least 30° (in the case of eight vanes >3 $\mu$m/degree over at least 40°, in the case of six vanes >2.5 $\mu$m/degree over at least 55°). The angular range 101 already mentioned then follows the angular range 107.

The variation of the cell volume which is limited by two of the vanes, particularly adjacent vanes, is also shown in the same diagram by a dashed line. The first or leading vane in the direction of rotation determines the angle plotted on the x-axis. It can be seen that the variation in chamber volume is offset in angular terms in relation to the course of the stroke. In principle, the variation in volume can be divided into three regions, namely an intake region 119, a precompression region 125 and a discharge region 131.

A pressure plate 20 which acts as a sealing surface at one side of the rotor can be seen partially in FIG. 1. It rests in a sealing manner against the lower end face of the rotor 5 and the contour ring 15 in relation to the plane of the drawing. A further pressure plate, which likewise acts as a sealing surface, rests against the upper end face of the rotor 5 and is not shown. Delivery cells 17 with a variable cell volume are developed between the circumferential wall 7 of the rotor 5, the inside wall 13 of the contour ring 15, the two pressure plates and each two adjacent vanes 11. In the intake region 119, the volume of the respective delivery cell 17 increases so that fluid is sucked into the cell through an intake opening 21 provided in the lower pressure plate 20.

As soon as that vane of the respective delivery cell 17 which vane is located to the rear with respect to the direction of rotation has passed over the leading edge 23 of the intake opening 21 in the direction of rotation, the connection between the delivery cell 17 and the intake region 21 is largely interrupted. The delivery cell 17 has reached the precompression region 125. By appropriate design of the contour ring 15, the delivery cell volume is reduced by a specific amount within this region. In the further course of the rotation of the rotor, the leading vane of the delivery cell 17 then reaches an edge 27 of a delivery opening 29 which communicates with the discharge region of the vane pump 1. Further reduction of the delivery cell volume conveys the fluid present therein through the delivery opening 29 into the discharge region, when passing through the discharge region 131.

Furthermore, a passage 33 can be seen in FIG. 1 in the precompression region 125. The passage is formed, for example, as a depression in the surface of the pressure plate 20 facing the rotor. It starts from the edge 23 of the intake opening 21, and extends in the direction of rotation. This passage 33 serves as a widening of the intake opening 21 into the precompression region 125. In the region of the passage, the lateral surface of a vane passing over the passage does not lie directly against the pressure plate, so that fluid present in the delivery cell 17 can flow back into the intake region 21 during the precompression.

In the present embodiment, this widening of the intake opening 21 is designed as a notch 33' whose tip points in the direction of rotation of the rotor 5, that is in the direction of the following or downstream discharge region. This decreases the cross section of the notch in the rotation direction and greatly decreases the surface of the notch 33' through which the fluid can flow, as viewed in the direction of rotation.

The mode of operation of the pump and, in particular, of the notch 33' is now described. During rotation of the rotor 5, a delivery cell 17, that is, the leading vane of that cell, reaches the intake region 119. The increasing cell volume sucks fluid in through the intake opening 21, for example from an oil sump. Very often air, which was previously introduced, for example, by the gears of an automatic transmission, is mixed in the oil being sucked in.

Immediately after the delivery cell 17, that is to say the trailing vane, has passed over the boundary between the intake region 119 and the precompression region 125, the connection between the delivery cell 17 and the intake opening 21 is substantially interrupted. Within the precompression region, the cell volume undergoes a reduction so that the pressure within the delivery cell 17 increases greatly due to the contour of the contour ring 15. This increase in pressure, however, is diminished by the fact that, during the build-up of pressure, oil flows from the delivery cell 17 via the notch 33' back into the intake region. Since the cross-sectional area of the notch 33' through which the fluid flows decreases in the direction of rotation, the quantity of oil flowing back is thus also reduced until the vane located at the rear has reached the tip of the notch 33'. The connection back into the intake region is thus closed.

The less steep increase in pressure in the precompression region 125 helps to prevent the undissolved air that is present in the oil from being compressed excessively and thus causing cavitation noises. Furthermore, the cell volume in the precompression region 125 can be reduced more sharply, in which case the ensuing great increase in pressure is diminished by the effect of the notch. In this case, the advantage lies in the fact that tolerance related deviations in the inside wall of the contour ring 15 no longer have such a great influence on the cell pressure.

As soon as the trailing vane of a delivery cell 17 has passed over the notch 33', the leading vane 11 reaches the rear edge 27 of the delivery opening 29, viewed in the direction of rotation. The delivery cell 17 thus communicates with the discharge region, and the diminishing volume of the delivery cell 17 leads to discharge of the oil enclosed in the delivery cell through the delivery opening 29.

Depending on the application, it is possible for the delivery cell 17 not to be opened toward the discharge region until the rear vane has passed over the notch 33'. However, it is also possible to permit an overlap, so that at least for a short time there is a fluid communication between the discharge region and the intake region via the delivery cell 17 and the notch 33'. This, however, does not lead to an appreciable short circuit owing to the very small flow cross section of the notch 33'.

Of course, in addition to the notch shape described, any other geometric shape for the passage 33 may be used.

The notch geometry brings about an increase in pressure which is virtually independent of the operating pressure in the precompression region, provided that there is no connection to the operating pressure via the delivery opening 29.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A vane pump comprising:

a casing having a bore and a contour ring around the bore;

a rotor rotatable about a rotor axis in the bore and having slots formed in the circumference of the rotor and extending inward radially;

radially displaceable vanes in the slots, the vane having end faces which rest against the contour ring as the rotor rotates, wherein the circumference of the rotor and the contour ring form an intake region, a precompression region, and a discharge region, respectively, in the direction of rotation, and wherein adjacent vanes, together with the rotor circumference and the contour ring, form delivery cells having volumes which vary as the delivery cells rotate through each of the intake region, the precompression region, and the discharge region, such that the cell volume increases during passage through the intake region, slowly decreases during passage through the precompression region, and more rapidly decreases during passage through the discharge region;

fluid intake and fluid delivery openings to the bore in the intake region and the discharge region, respectively;

the contour ring effecting a flattened vane stroke reduction rate along the precompression region so as to provide a strong kinematic precompression in a delivery cell formed between two adjacent vanes passing through the precompression region between the intake and the delivery openings, wherein the strong kinematic precompression is greater than a desired precompression;

the intake opening to the bore including a widening which extends in the direction of rotation and in part communicates to the bore in the precompression region to diminish a steep increase in pressure in a delivery cell passing through the precompression region to a desired lesser value, wherein the only communication with the precompression region of the bore is the intake opening, the delivery opening, and the widening of the intake opening.

2. The vane pump of claim 1, wherein the changes in cell volumes when passing through the intake region, the precompression region, and the discharge region are effected by the shape of the contour ring.

3. The vane pump of claim 1, wherein the widening of the opening is generally notch-shaped having a narrowing cross-section in the direction of rotation.

4. The vane pump of claim 1, wherein the widening of the opening is designed as a gradually decreasing width notch having a tip pointing in the direction of rotation.

5. The vane pump of claim 1, wherein the widening of the opening in the direction of rotation is sized such that fluid communication between the intake opening and the delivery opening via a cell defined between two adjacent vanes will occur.

6. The vane pump of claim 1, wherein the widening of the opening in the direction of rotation is sized so as to prevent fluid communication between the delivery opening and the intake opening via a cell bordered by at least two of the vanes passing between the intake opening and the delivery opening.

7. The vane pump of claim 1, wherein there are two of the intake openings and two of the intake regions, each intake region being followed in the direction of rotation by a respective precompression region and thereafter by a respective discharge region; and a respective discharge opening to each of the discharge regions.

8. The vane pump of claim 1, wherein there are ten of the grooves and, respectively, ten of the vanes.

9. The vane pump of claim 8, wherein the change in stroke of one vane traveling through the precompression region is greater than 3.5 $\mu$/degree over an angular range of at least 30°.

10. The vane pump of claim 1, further comprising a sealing surface at the side of the bore and the rotor and serving as a pressure plate over the side of the bore, the widening of the opening comprises a groove in the surface of the pressure plate facing the rotor, the groove being shaped as to be open at the edge thereof toward the intake opening.

11. The vane pump of claim 2, further comprising a sealing surface at the side of the bore and the rotor and serving as a pressure plate over the side of the bore, the widening of the opening comprises a groove in the surface of the pressure plate facing the rotor, the groove being shaped as to be open at the edge thereof toward the intake opening.

* * * * *